US007611010B2

(12) United States Patent
Gammons

(10) Patent No.: US 7,611,010 B2
(45) **Date of Patent: *Nov. 3, 2009**

(54) HAND HELD REMOTE COVER

(75) Inventor: Clifford Eugene Gammons, Loudon, TN (US)

(73) Assignee: Adroit Development, Inc., Loudon, TN (US)

( * ) Notice: Subject to any disclaimer, the term of this patent is extended or adjusted under 35 U.S.C. 154(b) by 364 days.

This patent is subject to a terminal disclaimer.

(21) Appl. No.: 11/609,639

(22) Filed: Dec. 12, 2006

(65) Prior Publication Data

US 2008/0140015 A1 Jun. 12, 2008

Related U.S. Application Data

(63) Continuation of application No. 10/774,810, filed on Feb. 9, 2004, now Pat. No. 7,147,105.

(51) Int. Cl.
*B65D 85/00* (2006.01)
*B65D 73/00* (2006.01)

(52) U.S. Cl. ..... 206/320; 206/484; 383/907

(58) Field of Classification Search ..... 206/305, 206/320, 438, 460, 484; D9/702–714; D14/250; D3/203.1, 300, 218; 383/36, 106, 108, 109, 383/907

See application file for complete search history.

(56) References Cited

U.S. PATENT DOCUMENTS 3,954,049 A 5/1976 Brieske
4,164,285 A 8/1979 Dorman
4,241,828 A 12/1980 Bourdelle et al.
4,358,015 A 11/1982 Hirsch
4,901,852 A 2/1990 King
5,069,337 A 12/1991 Bala
D355,302 S 2/1995 Eva et al.
D369,607 S 5/1996 MacGilvary et al.
5,638,661 A 6/1997 Banks
5,699,909 A 12/1997 Foster
5,769,224 A 6/1998 Poncy et al.
5,795,632 A 8/1998 Buchalter
6,224,543 B1 5/2001 Gammons et al.
6,672,456 B2 1/2004 Russell
7,147,105 B2 12/2006 Gammons
2003/0234194 A1 12/2003 Clark et al.

*Primary Examiner*—J. Gregory Pickett
(74) *Attorney, Agent, or Firm*—Knox Patents; Thomas A. Kulaga

(57) ABSTRACT

A sheath is disclosed for covering a manually manipulated controller having at least one user accessible control thereon. The sheath is elongated and includes a nose portion and linear side portions forming a sheath perimeter removably secured to a carrier for dispensing the sheath therefrom. The sheath includes at least one shoulder segment having a scalloped first shoulder transition and a curved second shoulder segment. The scalloped first shoulder segment provides expansibility in excess of the expansibility of the curved second shoulder segment, thereby providing flexible material that is readily manipulated without tearing when the sheath covers the controller and the user manipulates the control covered by the sheath.

20 Claims, 4 Drawing Sheets

HAND HELD REMOTE COVER

CROSS-REFERENCE TO RELATED APPLICATIONS

This is a continuation of application Ser. No. 10/774,810, filed Feb. 9, 2004, now U.S. Pat No. 7,147,105, issued on Dec. 12, 2006.

STATEMENT REGARDING FEDERALLY SPONSORED RESEARCH OR DEVELOPMENT

Not Applicable

BACKGROUND OF THE INVENTION

1. Field of Invention

This invention pertains to a sheath for covering hand-held devices and more particularly concerns a sheath configured for enclosing a hand-held device having controls thereon in a manner to facilitate a user's manipulation of the controls on the enclosed hand-held device.

2. Description of the Related Art

Modern hospital facilities and walk-in medical clinics require disinfection of surfaces and devices utilized in a medical treatment room or in a recovery room to minimize the spread of infectious diseases. A multitude of hand-held auxiliary devices may require covering with a sterile sheath when the device is utilized to remotely control medical equipment such as adjustable beds, video display units for viewing surgical procedures, ultrasound power units, and/or television units utilized by the medical staff or utilized by the patient during post-operative recovery. Moreover, certain investigatory medical probes having controls thereon must be enclosed by a sterile cover before use to guard against contamination.

Prior art devices have involved covering a hand-held device with a generally planar film of material, or inserting a medical probe into a sheath of material having generally planar sides. These hand-held devices or medical probes often includes one or more controls positioned on their exterior surface. No prior art sheath of this type is known which provides adequate accommodation for the manipulation of the buttons, calibrating dials, or adjusting knobs, frequently associated with these devices. Thus, in the prior art there exists a potential for tearing of the film exists when attempting to manipulate the button, dial, or knob. For a device or probe having controls protruding from opposing sides of the device, the opposed side controls can unduly stretch the planar sides of the sheath when the device or probe is inserted into the sheath. Stretching of the sheath sides poses an increased risk of tearing the sheath material during insertion of the device or probe into the sheath and/or during manipulation of the controls.

Moreover, there is an absence of tactility when seeking to operate the control of a device or probe which is enclosed in a straight sided sheath.

BRIEF SUMMARY OF THE INVENTION

According to one embodiment of the present invention, a sheath is disclosed for covering a manually manipulated controller having at least one accessible button control and/or at least one rotary control projecting from one of the exterior surfaces of the controller. The sheath, when viewed in a flat plan view, includes top and bottom flexible panels, each formed from a flexible and substantially transparent film, the panels having like contoured perimeters. The top and bottom panels are overlaid one upon the other with their respective contoured perimeters in register, and are bonded further to one another along the respective overlaid nose segments and respective linear side portions.

Each contoured perimeter includes a rounded first closed end or nose segment and first and second opposite generally linear side edges extruding from the nose segment to an open end of the sheath. One of the linear side edges of each of the top and bottom panels includes a shoulder portions interposed along the length of a respective side edge. The like-configured shoulder portion of the top and bottom panels are in register when the top and bottom panels are overlaid one upon the other, thereby defining a lateral pouch along the side edge of the sheath (when the sheath is opened). The lateral pouch is adapted to receive therein a manually manipulated controller which projects from a side surface of the device or probe. To accommodate the insertion of the projecting controller of a device or probe, in the preferred embodiment, that portion of the sheath between its open end and its shoulder is of a larger diameter (when open) than the diameter of the sheath between its nose portion and its shoulder. This structure permits close fitting of the distal end of the device and the nose portion of the sheath.

In a preferred embodiment each shoulder portion defines a scalloped interruption of its respective linear side portions. The scallops of each interruption exhibits enhanced tactility of the respective surfaces and enhanced expansibility in excess of the expansibility of the uninterrupted portions of a side edge of the sheath for the receipt therein of at least one button control or the rotary control of the hand-held controller when the controller is disposed within the sheath. The preferred scalloped interruption includes multiple scallops, hence defines a plurality of interconnected relatively small pouches when the sheath is expanded. Such plurality of pouches collectively provide a three-dimensional expanse of the sheath for receiving a controller of a device or probe. These structures provide for ease and precise manipulation of controller plus minimization of the chance of tearing of the sheath material covering the controller.

BRIEF DESCRIPTION OF THE SEVERAL VIEWS OF THE DRAWINGS

The above-mentioned features of the invention will become more clearly understood from the following detailed description of the invention read together with the drawings in which.

DETAILED DESCRIPTION OF THE INVENTION

Figure 1:
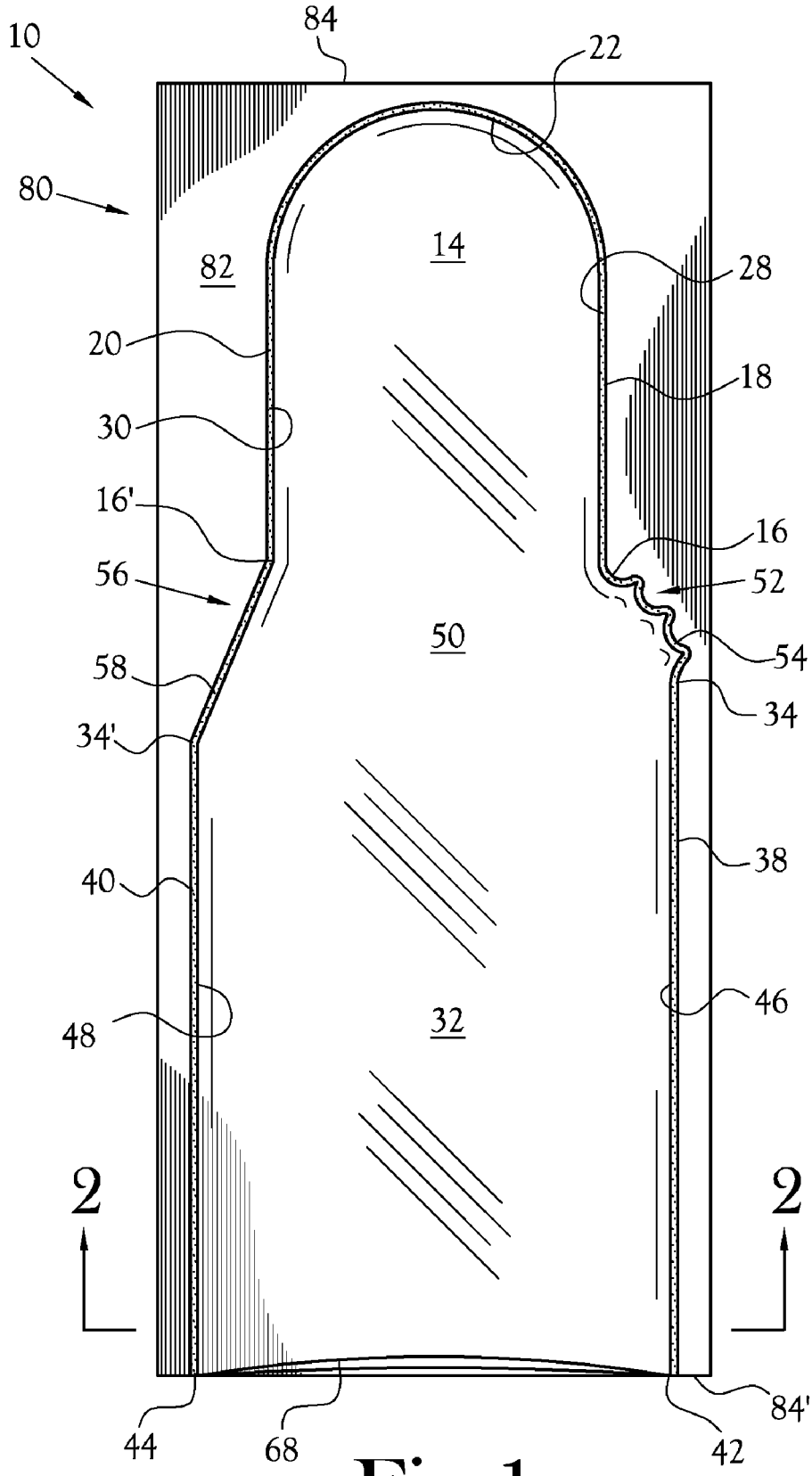
FIG. 1 is a plan view of a sheath of the present invention, illustrating the sheath in profile and secured to a carrier.

A sheath 10 of flexible material is disclosed for covering a hand-held controller device 70 having a plurality of controls 72, 74 thereon which require manipulation by an operator for utilization of the device 70. The sheath 10 is releasably secured along a portion of its perimeter 22 to a carrier 80 as illustrated in FIG. 1. The sheath 10 is released from the carrier 80 during positioning of the controller device 70 therein to provide a sterile layer covering the controls 72, 74 of the device 70 during manipulation by the operator.

Figures 2, 3:
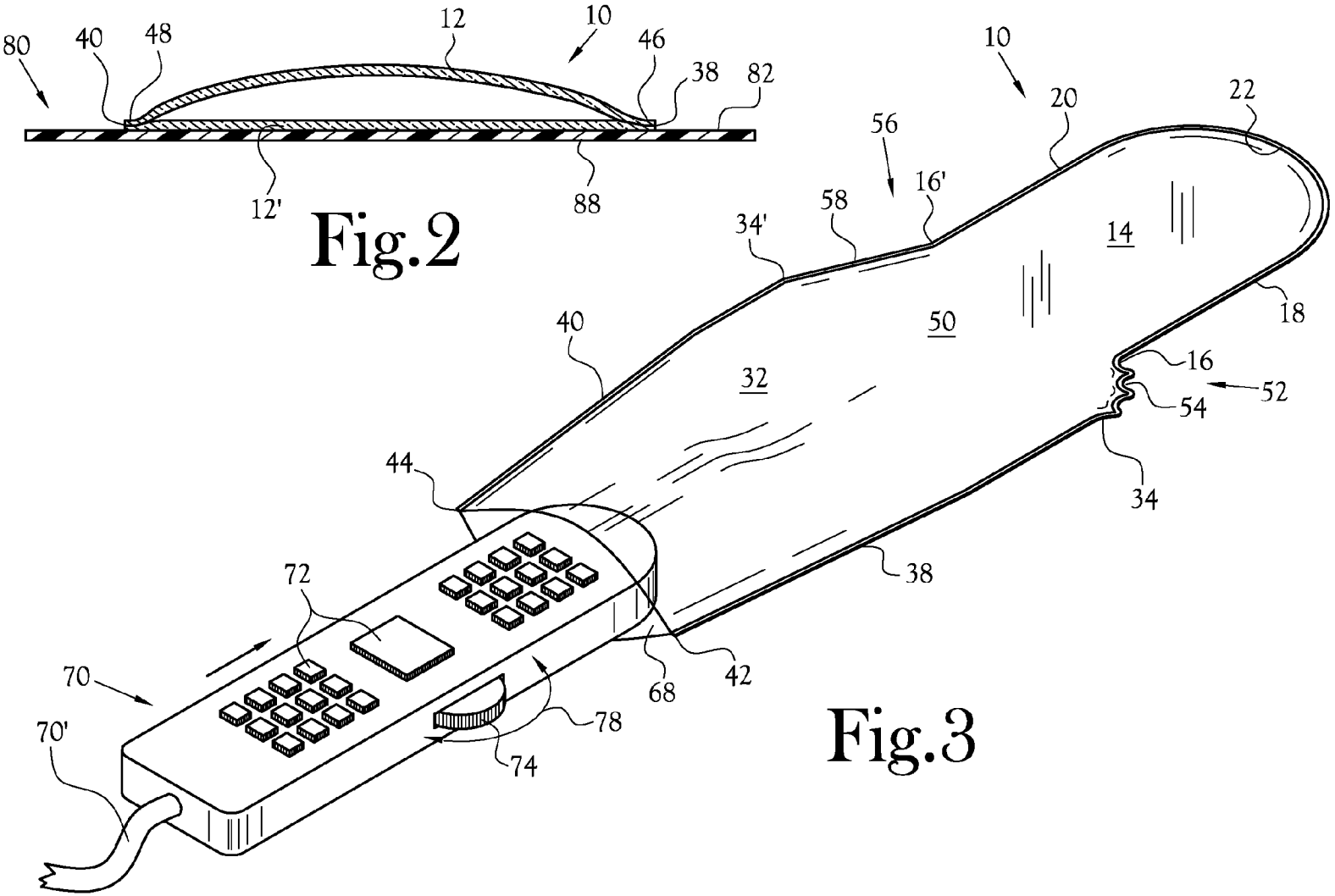
FIG. 2 is a sectional view taken along line 2-2 in FIG. 1, illustrating the lower side edges of the sheath bonded to the carrier.
FIG. 3 is a perspective view of the sheath of the present invention, illustrating insertion of a hand-held controller into the sheath.

The sheath 10 is composed of at least one layer of flexible material having a top panel 12 and a like-configured bottom panel 12' as illustrated in cross-section in FIG. 2. The top and bottom panels 12, 12' are configured to include a rounded first end identified as a nose segment 14, and first and second opposite side edges extruding from the nose segment 14 to a second end identified as an open end 68. The thickness of the sheath material is selected to provide a preferred flexibility for the sheath 10 to encircle the controller device 70 while providing a desired strength in order to withstand tearing during repetitive manipulation of the sheath material covering one or more controls 72, 74. The thickness of the sheath material is selected from a thickness ranging between about 0.5 mils to about 2.0 mils. Examples of the sheath material include a poly-ether urethane, a sterilizable polymer material such as a hybrid plastic such as metalacine plastic, or a similarly pliable and sterilizable polymer material. The sheath material is preferably transparent, allowing visual accessibility for observing the hand-held controller 70 positioned therein.

The rounded nose segment 14 includes a contoured perimeter 22 that is sealed along the edges to form a closed first end. The nose segment 14 provides a first width of sheath material that extends between opposed generally linear side portions 18, 20 to respective second end corners 16, 16'. The first width of sheath materials is of a sufficient width to accept the typical controller device 70 therein. A first linear side portion 18 extends from the rounded nose end to the second end corner 16 proximal of a first shoulder segment 52. A first linear edge 28 is formed by bonding the first side portion of the top panel 12 aligned in register with a like-configured first side portion of the bottom panel 12'. A second linear side portion 20 extends from the rounded nose end to a second end corner 16' proximal of a second shoulder segment 56. A second linear edge 30 is formed by bonding the second side portion of the top panel 12 aligned in register with a like-configured second side portion of the bottom panel 12'. Sealing of the edges of the nose end and first and second side portions 18, 20 of the top and bottom panels 12, 12' is accomplished by means for bonding along the contours of the respective edges of the respective linear side portions and respective shoulder portions of the overlaid panels aligned in register. The means for bonding can be accomplished by heat welding, ultrasonic welding, or other means known to those skilled in the art for bonding panels of flexible material together along aligned panel edges.

Figure 4A:
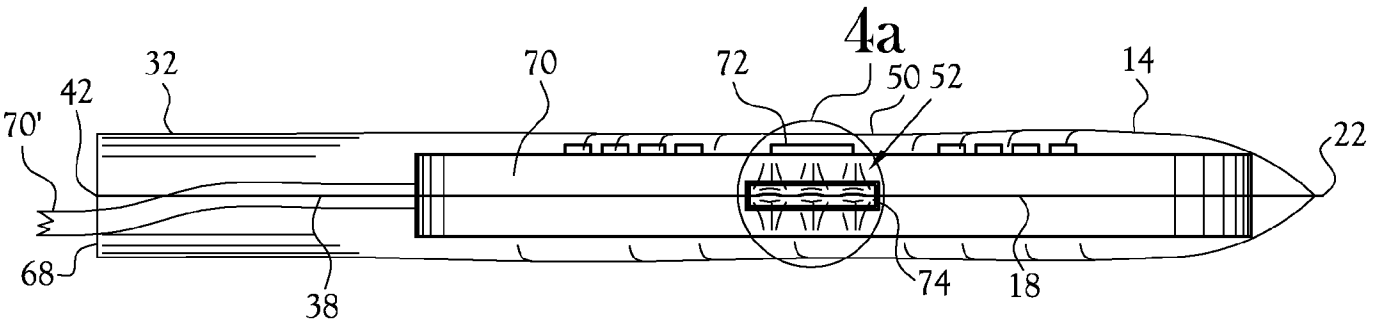
FIG. 4*a* is a side view of FIG. 3, illustrating the controller having a rotary control covered by a contoured shoulder of material.
Figure 4B:
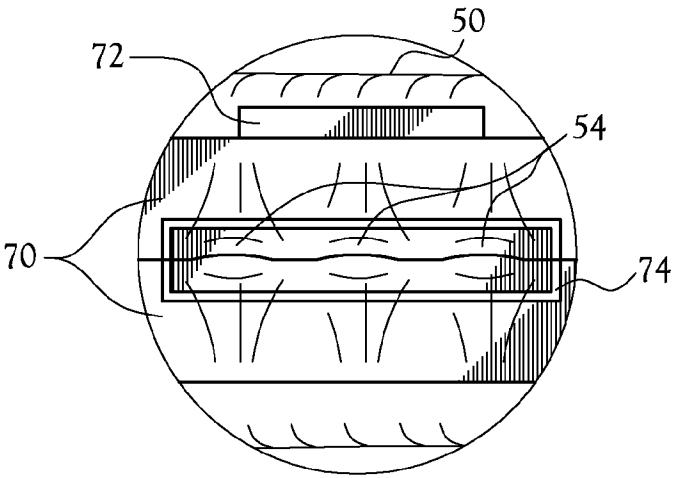
FIG. 4*b* is a close-up side view of FIG. 4*a*, illustrating the contoured shoulder of material expanded to cover the rotary control.

In one embodiment, the shoulder segment 50 forms a transition segment at approximately the mid-portion of the length of the sheath 10. A first shoulder segment 52 is disposed to extend laterally from the second end corner 16 of the nose segment 14, to the first end 34 of the third linear side portion 38. The first shoulder segment 52 includes an arcuately scalloped edge as illustrated at 54 in FIGS. 1 and 3. The scalloped edge 54 defines a convoluted edge having curved extensions and providing a scalloped interruption of its respective linear side portions 18, 38 of flexible material as viewed in profile (see FIGS. 1 and 3). The scalloped edge 54 exhibits enhanced expansibility in depth as illustrated in FIGS. 4*a* and 4*b* that is in excess of the minimal expansibility of an uninterrupted portion of a second shoulder segment 56 (see FIG. 1). The expansibility of the scalloped edge 54 is provided by a gathering of flexible sheath material that defines a plurality of interconnected and relatively small lateral pouches along the first shoulder segment 52 when the sheath 10 is expanded. Such plurality of pouches collectively provide a three-dimensional expanse of the first shoulder segment 52 adapted to receive therein a manually manipulated rotary control 74 projecting from a side surface of the controller 70.

The improvements provided by the scalloped edge 54 include an increased tactility of the flexible sheath material as compared to straight sided sheath coverings, thereby allowing the user to readily and precisely manipulate 78 the rotary control 74 covered by the plurality of pouches along the scalloped edge 54 (see FIGS. 3, 4*a*, and 4*b*), while minimizing the chance of tearing of the sheath material during repetitive manipulating of controls. Alternatively, the scalloped edge 54 is positionable over a switch or "push/pull" buttons 72 on the controller 70, with the expansibility of the scalloped edge 54 allowing a user to repetitively grip and manipulate the buttons 72 without tearing the flexible material enclosing the controller 70. As further illustrated in FIG. 5, the gathering of flexible materials along the scalloped edge 54 allows the sheath material to be manipulated 60 longitudinally and/or laterally relative to the controller 70".

The second shoulder segment 56 includes an angled edge 58 that forms an uninterrupted angled linear transition between the second end corner 16' and a first end 34' of the fourth linear side portion 40. The angled edge 58 can be linearly angled at between about thirty degrees to about fifty degrees directed inwardly toward the nose segment 14. A preferred angle for the angled edge 58 is about forty-five degrees directed inwardly toward the nose segment 14. The scalloped edge 54 and the angled edge 58 provide a transition for a reduced diameter of the nose segment 14 of between about three to about four inches, compared to a greater diameter of between about four inches to about five inches for the lower segment 32 and open end 68. Alternative diameters for the nose segment 14 and the lower segment 32 and open end 68 are readily provided. The greater diameter of the lower segment 32 compared to the reduced diameter of the nose segment 14 permits close fitting of the distal end of a controller 70 within the nose segment of the sheath 10. The edges of the open end 68 are not bonded together although the top and bottom panel edges are collapsible together to enclose a controller 70 while allowing a wiring cord 70' extended from the controller 70 to exit between the collapsed edges of the open end 68.

The sheath 10 includes a lower panel segment 32 having side boundaries of a third linear side 38 and a fourth linear side 40. The third linear side 38 is extended from a first end 34 adjacent the first shoulder segment 52, to a second end corner 42 of the open end 68. The third linear side 38 is sealed by the means for bonding to form a third side perimeter 46 by the means for bonding along the edge contours of respective sides of the overlaid panels 12, 12' aligned in register. The fourth linear side 40 is extended from a first end 34' adjacent second shoulder 58, to a second end corner 44 of the open end 68. The fourth linear side 40 is sealed by the means for bonding to form a fourth side perimeter 48 along the edge contours of the respective sides of the overlaid panels 12, 12' aligned in register.

Figure 5:
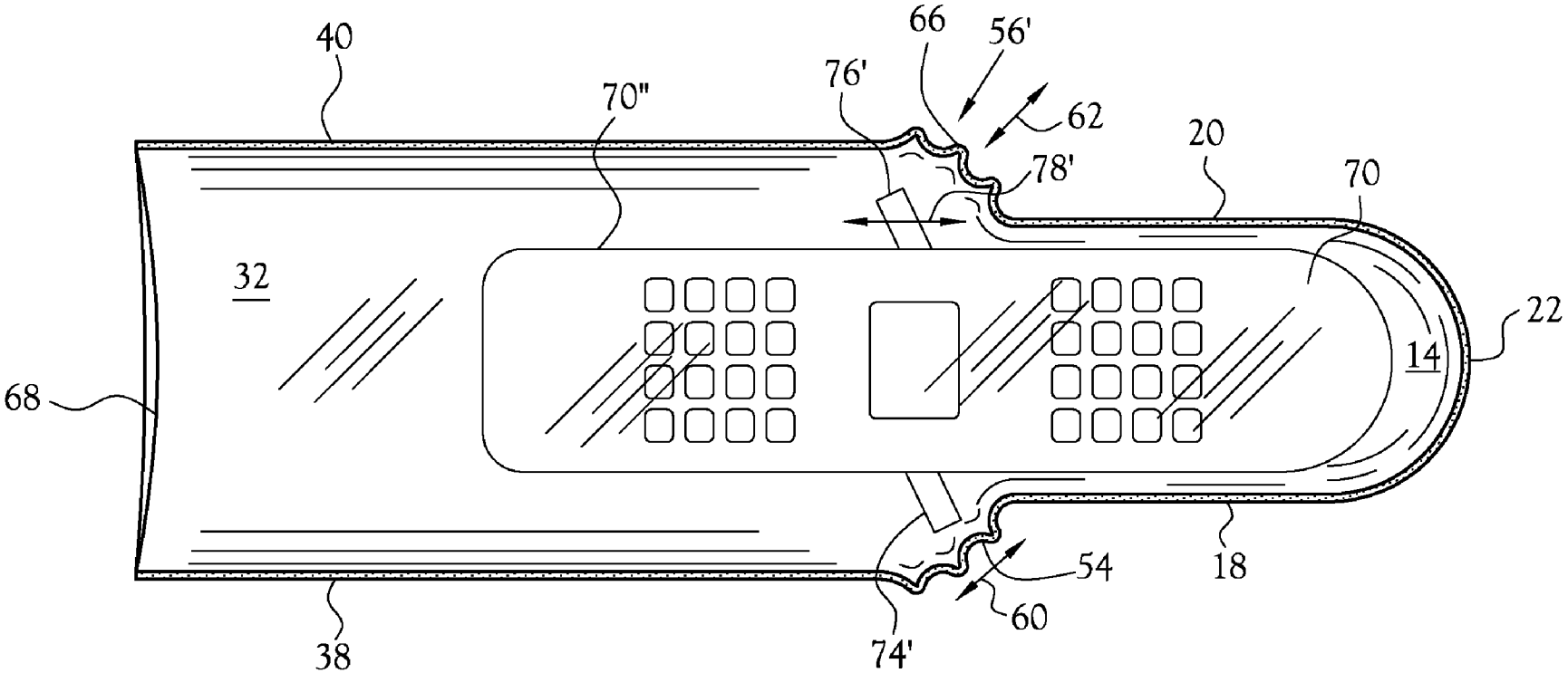
FIG. 5 is a plan view of FIG. 1, illustrating an alternate embodiment of a sheath having opposed contoured shoulders covering opposed rotary controls on the controller.

An alternative embodiment of the sheath 10 is illustrated in FIG. 5, including a second shoulder segment 56' having a convoluted profile of material such as a scalloped edge similar to the first shoulder segment 52. As discussed herein for the first scalloped edge 54, the second shoulder segment 56' includes a second scalloped edge 66 having a gathering of flexible material that is manipulated 60 similar to first scalloped edge 54. The second scalloped edge 66 is expansible longitudinally and laterally and provides a gathering of flexible sheath material that defines a plurality of interconnected relatively small pouches similar to first scalloped edge 54 (see FIG. 4*b*) that collectively provide a three-dimensional expanse of the sheath 10 for receiving therein a controller device 70" or a medical probe. The plurality of interconnected small pouches along the opposed scalloped edges 54, 66 provide for enhanced tactility of the respective surfaces 54, 66 for precise manipulation of respective controls 74', 76' while minimizing the chance of tearing of the sheath material. The scalloped edges 54, 66 of each interruption also exhibit enhanced expansibility in excess of the expansibility of the uninterrupted portions of a side edge of a planar sheath, thereby allowing for receipt therein of a rotary control 74 or respective controls 74', 76' of a controller of significant width and depth when disposed within the sheath 10. In addition, the expansibility of the plurality of pouches allows manipulation inwards and outwards 62 of a toggle control 76' mounted on the side of the controller 70". As illustrated in FIG. 5, each respective side control 74', 76' is preferably positioned proximally interior of the respective pouches defined by the respective scalloped edges 54, 66. The flexible sheath material along the open end 68 is not bonded together and is collapsible upon itself to enclose a base portion 70" of a battery operated remote controller 70" lacking a power cord (see FIG. 5).

To provide a tubular sheath 10 which is readily stored without destructive folding, and is rapidly dispensed without binding when needed, the two overlaid panels 12, 12' are aligned with their respective contours in register and are releasably mounted along the sheath outer perimeter onto a generally planar carrier 80. The carrier 80 includes first end 84, second end 84', and a receiving surface 82 extended therebetween for receiving the sheath 10 in an elongated position thereon. The receiving surface 82 is preferably fabricated from paper stock having a gloss finish thereon. The receiving surface 82 includes a polymer material encapsulated thereon, onto which the sheath 10 is releasably secured along its perimeter. The back side 88 of the carrier 80 is fabricated of paper stock that may have a gloss finish thereon, or may be fabricated without a gloss finish. The carrier 80 having at least one sheath 10 mounted thereon is readily stacked on additional like-configured carriers 80 having at least one sheath mounted thereon for enclosure within a storage package (not shown). The sheath 10 is releasably secured to the carrier 80 by means for bonding known to those skilled in the art. The method of mounting can include heat welding, ultrasonic welding, or other means known to those skilled in the art for releasably sealing a flexible polymer material along a perimeter 22 to a carrier 80 composed of flexible paper stock material. The heat welding or ultrasonic welding generates small amounts of melted sheath material that releasably seals the perimeter 22 to the carrier 80. The sheath open end 68 is preferably not bonded to the carrier 80 to allow release from the flexible carrier 80 during a step of enclosing a hand-held controller 70 inserted into the open end 68 (see FIG. 3). When the sheath 10 is removed from the flexible carrier 80 and rotated about ninety degrees about the sheath's lengthwise axis, the sheath side profile is generally planar for the overlaid panels 12, 12' when bonded together. The generally planar panels 12, 12' allow the sheath 10 to have a substantially flat configuration when mounted onto the carrier 80 and allows a plurality of like-configured sheaths individually mounted on flexible carriers to be assembled in a layered and stacked configuration within a portable storage receptacle (not shown). The portable storage receptacle also serves as a dispensing means that maintains each sheath 10 and carrier 80 in a generally contaminant-free enclosure while allowing for rapid dispensing of each sheath 10 and carrier 80 from the receptacle for use by medical personnel.

A method of utilization is disclosed for enclosing a hand-held controller 70 within a flexible sheath 10. The method includes inserting a first end of the controller into the open end 68 of the sheath 10 mounted on the carrier 80. As the controller 70 is inserted into the sheath 10, the third and fourth side portions 38, 40 are released from the carrier 80. Upon completion of the step of inserting, the sheath 10 is completely released from the carrier 80 and at least one of the controls 72, 74 is positioned proximal of the interior curvature of the first scalloped edge 54. For a controller 70 having two opposed controls (see FIG. 5), each respective control 74', 76' is positioned proximal of the interior curvature of respective scalloped edges 54, 56' of the sheath shoulder segment 50. Upon completion of the step of positioning, the expansibility of the scalloped edges 54, 56' of the sheath 10 is utilized for a user to manipulate one or more controls 74', 76' without tearing of the material of the sheath 10.

Those skilled in the art will recognize that additional configurations of the hand held remote cover having alternative length and width configurations can be provided without departing from the spirit and scope of the present invention. While the present invention has been illustrated by description of several embodiments and while the illustrative embodiments have been described in considerable detail, it is not the intention of the applicant to restrict or in any way limit the scope of the appended claims to such detail. Additional advantages and modifications will readily appear to those skilled in the art. The invention in its broader aspects is therefore not limited to the specific details, representative apparatus and method, and illustrative examples shown and described. Accordingly, departures may be made from such details without departing from the spirit or scope of applicant's general inventive concept.

The invention claimed is:

1. A sheath for covering a hand-held device having at least one user manipulated switch control or a rotatable control thereon, comprising:

a tubular sheath of flexible material having an open end, a nose end and a perimeter extended between said open end and said nose end, said tubular sheath including top and bottom flexible panels, said top panel including a contoured perimeter and said bottom panel including a substantially like-configured perimeter, said top and bottom flexible panels being bonded to one another along a portion of the respective of said contoured perimeters;

a first and second shoulder segment disposed medially along respective first and second sides; and said first shoulder segment defining an uninterrupted transition on said first side between a nose segment and an opposite segment, said second shoulder segment defining a scalloped transition on said second side between said nose segment and said opposite segment, whereby said scalloped transition exhibits expansibility in excess of the expansibility of said uninterrupted transition for receipt therein of the at least one control of the hand-held device when disposed within the sheath.

2. The sheath of claim 1 wherein said scalloped transition is disposed along said first shoulder segment, whereby when said scalloped transition is disposed to cover one of the controls on the device, said scalloped transition provides flexible material expansible during manipulation of the respective control by the user, said flexible material is resiliently returned to a pre-manipulation configuration after cessation of the user's manipulation of the at least one control on the device without tearing of said flexible material of said sheath.

3. The sheath of claim 1 wherein said first and second shoulder segments are located substantially midway between said nose end and said open end.

4. The sheath of claim 1 further comprising a carrier having a receiving surface for releasably securing said sheath in an elongated position thereon, said sheath being releasably secured to said carrier along at least a portion of said contoured perimeter of said sheath by said means bonding, whereby said sheath is removed from said carrier when the hand-held device is disposed within said sheath.

5. The sheath of claim 4 wherein said uninterrupted transition is disposed on said second shoulder segment and further includes:

an arcuately angled second shoulder having a convoluted profile of material extended from an arcuately angled side, whereby when said arcuately angled side is removed from said carrier by the hand-held device positioned therebetween, said convoluted profile of material is stretched over the controls on the hand-held device for user manipulation thereof without tearing said sheath.

6. A sheath for covering a hand-held device having a control that is user manipulatable, said sheath comprising:

a first segment having an open end, said first segment having a first diameter, said first segment dimensioned and configured to allow a distal portion of the hand-held device and the at least one control to pass through said first segment, said distal portion defined by a portion of the hand-held device between the control and a distal end of the hand-held device;

a nose segment having a closed end, said nose segment having a second diameter, said second diameter being less than said first diameter, said nose segment dimensioned and configured to receive said distal portion of the hand-held device after said distal portion passes through said first segment;

a shoulder segment connecting said first segment and said nose segment medial to said open end and said closed end, said shoulder segment providing a transition between said first diameter and said second diameter; and a first shoulder in said shoulder segment, said first shoulder including a plurality of pouches that are interconnected to provide a three-dimensional expanse of said shoulder segment that defines said first shoulder, said first shoulder positioned proximate the control on the hand-held device when said distal end of the hand-held device is received in said nose segment.

7. The sheath of claim 6 wherein said first and second shoulder segments are located substantially midway between said nose end and said open end.

8. The sheath of claim 6 wherein said first segment, said nose segment, and said shoulder segment are defined by a pair of sheets, said pair of sheets being substantially congruent and joined along an edge extending from one side of said open end across said closed end to an opposite side of said open end.

9. The sheath of claim 8 further including a carrier sheet, said carrier sheet having a surface releasably securing one of said pair of sheets to said surface.

10. The sheath of claim 8 further including a carrier sheet, said carrier sheet having a surface releasably securing one of said pair of sheets to said surface, said pair of sheets and said carrier sheet having a substantially flat configuration when said one of said pair of sheets is attached to said surface of said carrier sheet.

11. The sheath of claim 6 further including a carrier sheet, wherein said first and second segments have a collapsed configuration that is substantially flat, said carrier sheet having a surface releasably securing one side of said collapsed configuration.

12. The sheath of claim 6 wherein said first segment, said nose segment, and said shoulder segment define a length, said length greater than a length of the hand-held device that said sheath is configured to receive wherein the sheath encloses the hand-held device.

13. The sheath of claim 6 wherein said first segment, said nose segment, and said shoulder segment define a length, said length is greater than a length of the hand-held device that said sheath is configured to receive, and said length includes an excess length configured to be collapsible to enclose the hand-held device.

14. An apparatus for covering a hand-held device having a control to be operated when the device is covered, said apparatus comprising:

a first sheet having a length between a first end and a second end, said first sheet having a first width proximate said first end and a second width proximate said second end, said first width wider than said second width;

a second sheet substantially congruent with said first sheet, said first and second sheets joined together along an edge extending along a first side, said second end, and a second side, said first side extending said length from said first end to said second end, said second side extending said length from said first end to said second end on an opposite side of said first sheet from said second side, said first end of said first sheet forming an open end with said second sheet;

a first segment defined by a first transition from said first width to said second width in a medial portion of said first sheet between said first and second ends, said first segment being an arcuately scalloped edge forming a plurality of interconnected lateral pouches when said first and second sheets are expanded; and a third sheet having a surface releasably attached to said second sheet, and said first, second, and third sheets having a substantially flat configuration when joined.

15. The apparatus of claim 14 wherein said first and second sheets being flexible wherein said first and second sheets are expandable to accommodate the hand-held device therebetween.

16. The apparatus of claim 14 wherein said first segment is positioned to be proximate the control when said hand-held device is received between said first and second sheets.

17. The apparatus of claim 14 wherein said first segment is a flexible material expansible during manipulation of the control by a user, said flexible material resiliently returning to a pre-manipulation configuration after cessation of the user's manipulation of the control on the hand-held device without tearing of said flexible material.

18. The apparatus of claim 14 further including a second segment defined by a second transition from said first width to said second width in a medial portion of said first sheet between said first and second ends, said second segment opposite said first segment, and said second segment forming a smooth transition from said first width to said second width.

19. The apparatus of claim 14 wherein said length is greater than a length of the hand-held device that said sheath is configured to receive wherein said apparatus encloses the hand-held device.

20. The apparatus of claim 14 wherein said length is greater than a length of the hand-held device that said sheath is configured to receive wherein said apparatus encloses the hand-held device, and said length includes an excess length configured to be collapsible to enclose the hand-held device.

* * * * *